US005251363A

United States Patent [19]

Gerhards et al.

[11] Patent Number: 5,251,363

[45] Date of Patent: Oct. 12, 1993

[54] METHOD AND APPARATUS FOR COMBINING DIFFERENTLY COLORED THREADS INTO A MULTI-COLORED YARN

[75] Inventors: Klaus Gerhards, Hückeswagen; Klaus Burkhardt, Schwelm, both of Fed. Rep. of Germany

[73] Assignee: Barmag AG, Remscheid, Fed. Rep. of Germany

[21] Appl. No.: 788,341

[22] Filed: Nov. 6, 1991

[30] Foreign Application Priority Data

Nov. 10, 1990 [DE] Fed. Rep. of Germany ..... 4035812
Feb. 2, 1991 [DE] Fed. Rep. of Germany ..... 4103526

[51] Int. Cl.[5] ..... D02B 11/00
[52] U.S. Cl. ..... 28/221; 28/263
[58] Field of Search ..... 28/219, 220, 221, 247, 28/258, 263, 262, 266, 267, 252, 264, 265; 264/73, 75; 57/264, 289, 333

[56] References Cited

U.S. PATENT DOCUMENTS 3,654,677 4/1972 Binford et al. ..... 28/220
3,680,303 8/1972 Kim ..... 28/220 X
3,924,311 12/1975 Stanley ..... 28/258
4,341,063 7/1982 Southerlin et al. ..... 28/220 X
4,526,808 7/1985 Strohmaier ..... 28/220 X
5,054,173 10/1991 Schafer ..... 28/263

FOREIGN PATENT DOCUMENTS 0133198 4/1984 European Pat. Off. .

*Primary Examiner*—Clifford D. Crowder
*Assistant Examiner*—Larry D. Worrell, Jr.
*Attorney, Agent, or Firm*—Bell, Seltzer, Park & Gibson

[57] ABSTRACT

A method and apparatus for producing multi-colored crimped yarns is disclosed, and which includes the steps of spinning a plurality of differently colored groups of filaments, subjecting the filaments of each group to a treatment liquid, and then combining the filaments to form respective strands. Each strand is then subjected to an air tangling process, then stretched and the strands are thereafter combined in a thermo-pneumatic texturizing process. This processing sequence produces multi-filament yarns with good color blending.

20 Claims, 1 Drawing Sheet

METHOD AND APPARATUS FOR COMBINING DIFFERENTLY COLORED THREADS INTO A MULTI-COLORED YARN

FIELD OF THE INVENTION

The invention relates to a method of and an apparatus for making multicolored crimped yarns from differently dyed endless filaments.

STATEMENT OF THE PRIOR ART

Methods of making yarns from differently dyed endless filaments are disclosed, for instance, by European Patent Application 0 133 198 and German Patent Application DE 40 14 639.1.

The practice of the prior art methods entails intermingling differently dyed yarns which may, however, result in finished yarns or strands which may display a mixed or diffused color rather than the desirable separately distinguishable colors.

OBJECT OF THE INVENTION

It is an object of the present invention to provide an improved method of making multi-colored yarns in which the different colors of the individual filaments are distinguishable, without, however impairing the quality of the crimping of the yarn.

As herein defined, the terms "thread" and "filament" are intended to connote single filament fibers, whereas such terms as "yarn" and "strand" are intended to connote multi-filament fibers. In accordance with the invention, the method of making a multi-colored yarn from differently dyed synthetic crimped fibers includes the steps of simultaneously spinning a plurality of differently dyed filaments in parallel relationship; subjecting the filaments to a treatment liquid; combining the filaments into differently colored strands; individually guiding each strand through an air tangling nozzle and subjecting each strand to a tangling process; stretching the strands separated from each other in parallel relationship on pairs of godets; stuffing the strands in common by means of a flow of heated gas in a stuffer box; cooling the strands; and winding the finished yarn into a package, whereby the parameters governing the tangling process are adjusted in such a way that under the influence of the stretching force the entanglement of the filaments of each strand is substantially loosened or weakened in such a way that the subsequent texturization is not impaired.

To produce a yarn from a synthetic thread, it has been common practice to combine the threads in a twisted manner by a so called tangling process. Tangling includes directing a flow of air against the strand of filaments transversely of its direction of movement. The resulting dislocation of the filaments leads to a knot-like intertwining and tangling of the filaments. As is well known, such a tangling process may take place in the spinning zone before the first godet of the stretching zone, or before the yarn is wound into a package. It has always been assumed, however, that tangling must in no circumstances take place prior to thermo-pneumatic texturization. In a thermo-pneumatic texturizing process a synthetic fiber strand is moved at high speed through a flow of heated gas or vapor, i.e., hot air or steam, and is then bulked by collision with a surface which for practical purposes may be the wad or plug formed by the strand itself.

As a consequence, individual filaments deposit themselves in a regularly bent configuration on an impact surface, and because of the heat-induced, the filaments retain this configuration. Subsequently, the configuration is "frozen", i.e., made permanent by a cooling process. It will be appreciated by those skilled in the art that such a process must not result in the filaments being connected to each other; for what is desired is not the deformation of the complete strand or yarn but, rather, the deformation of the individual filaments. An interconnection of the filaments would occur, however, if as a result of tangling the filaments would physically or frictionally adhere or connect to each over.

Experience and practice suggest, therefore, that in a thermo-pneumatic texturizing process tangling of the filaments must be deferred until after the texturization, but mitigate against it taking place prior to the texturization.

The invention departs from this teaching and proposes to tangle each strand separately. Intermingling, i.e., adherence of the filaments with each other is substantially avoided by appropriately setting the tangling parameters. The tangling parameters are set at such levels that the frictional engagement between the filaments of the individual strands is such that it is subsequently loosened or weakened by the stretching forces applied to the strands during the stretching operation. Also, the tangling process is practiced at an intensity which prevents the formation of knots at substantially regular intervals along the length of the strand. Rather, an essentially uniform intermingling of the filaments with each other is achieved over the length of the strand.

While stretching of the strands causes, to a substantial extent, the severance of the connection between the filaments obtained during tangling, it is not clear why the subsequent thermo-pneumatic texturizing process does not lead to an intermingling of the differently dyed filaments, and why the intermingled fibers obtained by stuffing may be recognized by their individual colors, although crimping takes place in a manner which suggests that the filaments had not previously been connected to each other. At present, there is no explanation of this phenomenon.

Test runs were conducted at tangling pressures of 0.5 bar and 5 bar. Both pressure levels yielded finished yarns the fiber strands of which were positioned adjacent each other, and their individual colors were clearly distinguishable. The use of higher tangling pressures led to totally unsatisfactory crimping.

Further trials may well reveal that tangling practiced as taught by the invention may take place within the stretching zone or between the stretching zone and the texturizing zone, provided the tangling parameters are calibrated to yield a sufficiently weak interconnection of the filaments during tangling which could subsequently be further weakened during the texturizing process or, at any rate, would not otherwise pose problems.

BRIEF DESCRIPTION OF THE DRAWING

The invention will hereafter be explained with reference to the drawing which schematically depicts an apparatus for making a thermo-pneumatically texturized yarn.

DESCRIPTION OF THE INVENTION

Figure 1:
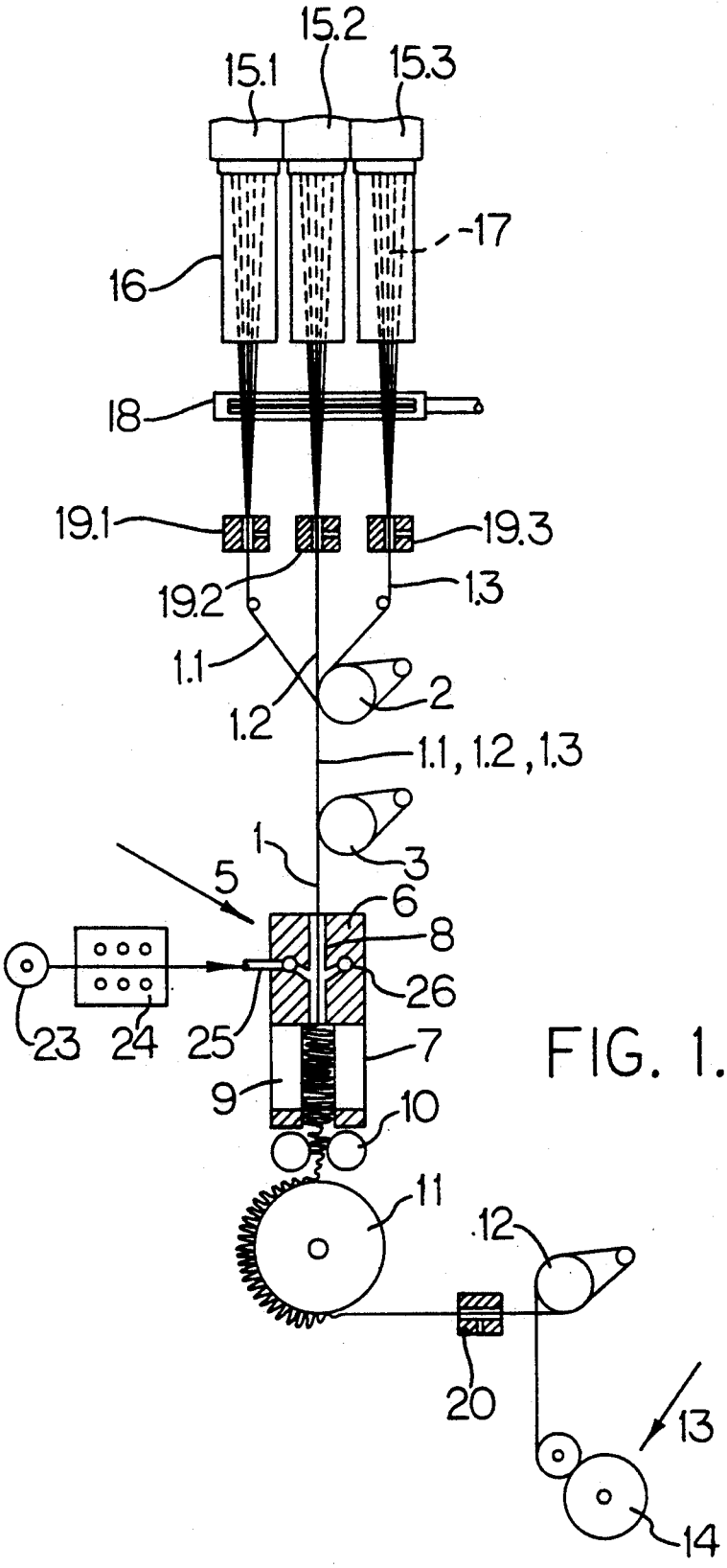

In the apparatus shown in FIG. 1 three different lots of thermoplastic polymer are melted and extruded as thin endless filaments 17, by spinning heads 15.1, 15.2 and 15.3. Each lot or charge is dyed differently. The filaments 17 are thereafter cooled in a cooling shaft 16, and are then guided over a common plane. Within the plane, there is provided an elongate straight nozzle 18 across the mouth of which the filaments 17 are drawn to be treated with a fluid. After the fluid treatment, the filaments are combined into strands 1.1, 1.2 and 1.3 of different colors. Each strand 1.1, 1.2 and 1.3 is guided across a tangling nozzle 19.1, 19.2 and 19.3 where it is subjected to a tangling process. The tangling parameters, especially air pressure, are calibrated to be identical for each strand. The tangling nozzles direct pressurized air towards the strands in a substantially vertical direction. In this manner, the individual filaments are dislocated in at least some locations of the strands, and in accordance with the invention they are preferably not physically connected to each other in a knot-like manner but, instead, are held together frictionally only.

Thereafter the three strands 1.1, 1.2 and 1.3 are commonly, but in separate substantially parallel relationship, guided onto two stretching godets 2 and 3 of a stretching zone. The strands are heated by godet 2 and stretched when moving onto godet 3. Following the stretching godet 3, there is provided a texturizing nozzle 5. The entrance portion 6 of the texturizing nozzle 5 comprises a yarn channel 8. Within the yarn channel 8 the strands 1.1, 1.2 and 1.3 are combined into a unitary or interlaced yarn. The entrance portion 6 is supplied with pressurized air from a source thereof by way of a conduit 25. The pressurized air is heated by a heater 24. The heated air is then blown into a channel 8 by way of an annular channel 26 and injection channels which enter the yarn channel 8 at an acute angle. In this manner, the yarn 1 is pulled off the stretching godet 3 and is moved at high speed by the flow of hot air.

The yarn channel 8 is connected to stuffer stuffing box 7 which is provided with lateral openings 9. Within the stuffer box 7 the yarn is piled up plug or wad. Movement of the yarn 1 into the stuffer box 7 causes the yarn to collide with itself and thus from bends and similar shapes. At the same time the yarn plug or wad is compacted under the influence of the air flow into the stuffer box 7, and slowly it is pressed out of the stuffer box 7. Compacting the wad or plug leads to intensified crimping. When the plug leaves the stuffer box 7 the lateral openings 9 are opened so that the air may escape from the stuffer box 7. As a result of the heated air impacting the yarn within channel 8, the yarn may be softened to some extent at least. This, in turn, leads to a self-regulation of the thickness of the plug and the pressure of the air in the stuffer box 7.

The yarn leaving the stuffer box 7 is advanced by feed rollers 10 and may be fluffed. Thereafter the yarn is guided across the porous surface of a rotating cooling drum 11. Vacuum pressure applied to the interior of the cooling drum 11 causes air of ambient temperature to flow through the plug of yarn placed on the porous drum 11. Finally, the yarn is moved on by a feed roller 12 and is guided to a package winding fixture 13. Before being wound up into a package, the yarn may be subjected to further intensive tangling by a tangling nozzle 20 positioned in front of the winding fixture 13. In this manner a bobbin 14 having excellent unwinding characteristics may be obtained.

What is claimed is:

1. An apparatus for making a multi-colored crimped yarn, comprising in the following sequential order of yarn flow:

means for spinning a plurality of differently dyed filaments in substantially parallel relationship;

means for subjecting said filaments to a treatment liquid;

means for combining said differently colored filaments into strands of different color;

means for air tangling said strands to provide releasable frictional engagement between said filaments;

means for stretching said strands for at least partially releasing said frictional engagement between said filaments;

means for forming a plug of said strands; and means for winding said plug into a package.

2. The apparatus of claim 1, wherein said tangling means comprises pressurized fluid means adjustable to between 0.5 and 5.0 bar.

3. The apparatus of claim 2, wherein said stretching means comprises at least first and second godet means.

4. The apparatus of claim 3, wherein at least one of said first and second godet means is heatable.

5. The apparatus of claim 4, wherein said plug forming means comprises a stuffer box and a source of pressurized fluid.

6. The apparatus of claim 5, further including means positioned between said plug forming means and said winding means for additionally texturizing said plug.

7. A method of forming a multi-colored crimped yarn, comprising the sequential steps of simultaneously spinning a plurality of groups of filaments, with said groups advancing in parallel directions, and with each group being of a color which is different from the color of at least one of the other groups, subjecting each filament of the groups to a treatment liquid, combining the filaments of each of said groups to form respective strands, guiding each of the strands through a flow of pressurized fluid and so as to subject each of the strands to a tangling process, stretching the strands by guiding them in parallel relationship over at least first and second godets, forming the stretched strands into a composite yarn by subjecting the strands to a flow of heated fluid while causing the strands to collide against a surface so as to form the strands into a plug, cooling the plug and withdrawing the composite yarn from the downstream end thereof, and winding the withdrawn composite yarn into a package.

8. The method as defined in claim 7 wherein the step of guiding each of the strands through a flow of pressurized fluid includes subjecting each of the strands to a separate flow of pressurized fluid.

9. The method of claim 7, wherein said strands are subjected to said tangling step substantially simultaneously.

10. The method of claim 9, wherein said tangling step includes subjecting said strands to a flow of fluid pressurized to between 0.5 and 5.0 bar.

11. The method of claim 10, wherein said tangling step includes connecting said filaments into releasable frictional engagement with each other.

12. The method of claim 11, wherein said stretching step includes heating said strands.

13. The method of claim 12, wherein said stretching step includes at least partially releasing said frictional engagement between said filaments.

14. The method of claim 7, wherein said surface comprises a portion of at least one of said strands.

15. The method of claim 14, wherein said plug forming step includes subjecting said strands to a heated fluid in a stuffer box.

16. The method of claim 15, wherein said heated fluid is pressurized air.

17. The method of claim 15, wherein said heated fluid is steam.

18. The method of claim 15, wherein said strands are at least partially softened.

19. The method of claim 18, wherein said cooling step includes solidifying said softened strands.

20. The method of claim 15, further including the step of additionally texturizing said strands between said plug forming step and said winding step.

* * * * *